United States Patent [19]

Robbins et al.

[11] 4,236,924

[45] Dec. 2, 1980

[54] PRODUCTION OF SINGLE PHASE ALLOY PARTS BY REDUCTION OF OXIDES

[75] Inventors: Murray Robbins, Berkeley Heights; Annemarie Staudinger, Chatham, both of N.J.

[73] Assignee: Bell Telephone Laboratories, Incorporated, Murray Hill, N.J.

[21] Appl. No.: 2,988

[22] Filed: Jan. 12, 1979

[51] Int. Cl.[3] ..... B22F 3/00

[52] U.S. Cl. ..... 75/211; 75/200

[58] Field of Search ..... 75/211, 200

[56] References Cited

U.S. PATENT DOCUMENTS

| | | | |
|---|---|---|---|
| 2,853,767 | 9/1958 | Burkhammer | 75/211 |
| 3,070,436 | 12/1962 | Triffleman | 75/211 |
| 3,459,546 | 8/1969 | Lambert | 75/211 |
| 3,473,914 | 10/1969 | Rick | 75/211 |
| 3,625,673 | 12/1971 | Lindquist | 75/211 |
| 4,089,921 | 5/1978 | Dobo | 75/211 |

*Primary Examiner*—Brooks H. Hunt

*Attorney, Agent, or Firm*—Peter V. D. Wilde

[57] ABSTRACT

In the process of producing metal alloy parts by the reduction of powder metal oxide compacts, it has been discovered that single phase alloy parts may be produced by an agglomerated mixture of metal oxides without a separate annealing step. The metal oxide mixture is formed into agglomerates by spray drying a solution of metal salts which are subsequently decomposed, or other techniques, compacted to the desired shape, and then reduced in a hydrogen atmosphere at high temperature. In the case of alloys that would otherwise segregate, a quenching step follows the reduction of the metal oxide shape. As only oxides are involved prior to reduction, problems with surface oxidation are avoided. A sintering step in air can be used to give the oxide compact structural integrity before reduction.

12 Claims, No Drawings

PRODUCTION OF SINGLE PHASE ALLOY PARTS BY REDUCTION OF OXIDES

BACKGROUND OF THE INVENTION

This invention is directed to a method of producing single phase metal alloy parts of a wide variety of shapes and a wide variety of alloy compositions by the reduction of metal oxide agglomerates.

The prior art of powder metallurgy teaches the production of metal parts by sintering powders of the desired metal alloy composition. First, the powder is formed into the desired shape, compacted, and then sintered to achieve densification with the time and temperature controlled to give the desired strength and porosity characteristics.

However, several limitations appear from working with metal powders. Firstly, many metal powders are so reactive in air that special steps must be taken to prevent surface oxidation prior to or during final fabrication. Such steps could include the use of inert atmospheres, or reducing the powders to remove surface oxidation just prior to or during fabrication. However, such steps tend to increase the cost of production. To overcome this first problem, metal oxide powders may be used rather than metal powders, with the formed oxide shape being reduced to a metal as the last step. See, for example, Swedish Pat. No. 127,524 and French Pat. No. 1,100,993.

A second limitation is that many mixtures of different metal powders do not readily form as a single phase alloy by sintering alone. To overcome this problem, the prior art requires an annealing step, typically requiring several hours. Alternately, in order to obtain single phase alloys, the metal components may be cooled from a melt in which they exist as a single phase. However, the melt technique loses the advantages of powder metallurgy, and requires generally higher temperatures. The prior art has not obtained complex single-phase shaped parts by the reduction of mixed oxides, but see "Sintering Phenomenon in Compacted Iron Powder (II)" by T. Nishijima, *J. Japan Soc. Powder Metallurgy,* 6 (1):19–24 (1959) for two component systems.

Clearly, it would be desirable to have a technique by which the advantages of powder metallurgy are realized in obtaining single phase metal alloy articles while avoiding long annealing times, and at the same time enjoying the advantages of working with oxide powders.

SUMMARY OF THE INVENTION

The present invention teaches the production of single phase metal alloy parts of a wide range of shapes and compositions without a conventional annealing step. This is achieved by the reduction of compacted metal oxide powders in the form of agglomerated mixtures. The only restriction as to the oxides' composition is (1) that the metal composition produced upon reduction of the oxide mixture be such that it is capable of forming a single phase alloy by any conventional heating and annealing steps at the reduction temperature, and (2) that the oxide mixture be fully reducible in the reducing atmosphere at a temperature below the melting point of the alloy formed. The steps of the present invention typically comprise:

(1) forming a metal oxide agglomerated mixture by spray drying, or freeze drying, or co-precipitation of a liquid solution of oxide salts which are decomposed to agglomerates of mixed metal oxides;

(2) compacting the agglomerated mixture of metal oxides into the desired shape; and (3) reducing the compact by means of a reducing atmosphere at an elevated temperature. Additionally, the part may be quenched after reduction in the case of alloys that would otherwise segregate into multiple phases upon cooling. Furthermore, the metal oxide compact may be sintered in air, for structural integrity prior to reduction. A binder material may also be used to obtain structural integrity of the metal oxide compact.

DETAILED DESCRIPTION

The following detailed description shows a method for making single phase metal alloy parts of a wide range of shapes and compositions. Metal oxide powders rather than metal powders are utilized as the working material prior to the reduction step. This allows all initial storage, forming and sintering steps to be accomplished in air, rather than in inert atmospheres, which reduces the cost of production.

Many single phase alloy compositions are difficult to make by standard powder metallurgy techniques, as the grains of different metal powders may not have enough time during sintering to diffuse so as to form a single phase alloy. This often requires a separate annealing step to achieve a single phase alloy. One advantage of the present invention is that compacted metal oxide agglomerated mixtures can be reduced to a single phase alloy without a separate annealing step. As used herein, "annealing" means holding the metal compact at a given temperature long enough to achieve a single phase alloy, and typically requires hours to accomplish. Quenching of alloys that would otherwise segregate following reduction may be required in the present teaching, as is necessary following the annealing step of the prior art. The present teaching retains the advantages of powder metallurgy, in that the powder oxide compacts can be formed in the shape of the desired finished metal part.

For the purpose of this invention, a "metal oxide" means an oxide containing at least one metal species; examples are $Fe_2O_3$ and $NiFe_2O_4$. A combination in the form of a mixture of a multiplicity of such metal oxides forms a "metal oxide mixture". Specifically, as used herein, such a mixture is not in the form of a single compound or solid solution of the component oxides.

The metal oxide powders used in this method are obtained by spray drying or freeze drying of liquid solutions of soluble metal salts which can be subsequently decomposed to metal oxides, or co-precipitation of mixed salts, such as hydroxides or oxylates, which are subsequently decomposed. The spray or freeze dried salts typically include acetates, ammonium acetates, citrates, ammonium citrates, sulfates, or ammonium sulfates, but other metal salts are possible. These techniques, herein referred to as agglomerating the oxides, are advantageous for insuring high homogeneity of the mixed metal oxide powders, and close contact between the different metal oxide species in the powders. By agglomerating the oxides, agglomerates are obtained which consist of mixtures of sub-micron size regions of the oxide species. The agglomerates themselves typically have diameters in the range of 5 to 20 microns, but other sizes are possible. With such agglomerated oxides, single phase alloys can be obtained directly by the reduction technique employed herein. Many such single phase alloys cannot be obtained by standard powder metallurgy techniques without much longer heating times (i.e., annealing) due to the relatively large grain sizes of commercially available metal powders. Such grains typically have diameters in the range of 30 microns and over. In fact, the inherent ductility of most metals makes it difficult if not impossible to obtain grains smaller than this by standard milling techniques. Other techniques, such as atomizing, may yield metal grains of about 10 microns. The sub-micron size oxide species in the agglomerates taught herein thus require much less time for diffusion to occur among the various metal species that form upon reduction. To a first approximation, the diffusion time necessary to form a single phase alloy will be inversely proportional to the diameters of the metal grains or regions. Thus, agglomerates with oxide regions having 0.2 micron diameters can form single phase metal alloys roughly 150 times faster after reduction occurs than can metal compacts having 30 micron diameter grains heated to a comparable temperature.

The metal oxide agglomerate mixture formed by the above procedure then may be combined with a binder and pressed into the desired shape, which may be the shape of the final product, as in the case of conventional powder metallurgy. The binder material used in the examples given herein is halowax initially dissolved in $CCL_4$. However, U.S. Pat. No. 3,418,104 teaches that water may also be advantageously used as a binder, up to about 4 percent by weight of the oxide shape. If halowax or a comparable organic substance is used the binder is next burned off in air. It is also noted in U.S. Pat. No. 3,418,104 that compaction of iron oxide actually aids the reduction process.

In some cases, the use of a binder may be omitted entirely, if a low degree of structural integrity before reduction can be tolerated. However, in many cases, particularly where the shape of the oxide compact is the shape of the desired final product, it is necessary to obtain more structural integrity of the oxide compact than a binder alone can provide, to allow for convenient handling of the part prior to reduction. It has further been found by the present inventors that if the oxide compact is heated in air so as to join the oxide agglomerates (referred to as sintering), reduction of such a sintered compact to a single phase alloy will still occur. This is very useful for obtaining structural integrity of the oxide compact while still working in air. Sintered densities in the range of 60–80 percent of theoretical oxide densities have been found to reduce properly, with a wider range being possible. Surprisingly, in many cases the lower initial oxide densities produce a higher density of the final reduced metal part. The reduction method employed herein uses hydrogen gas. However, the inventive method of producing single phase alloys can be utilized with any appropriate reducing atmosphere, such as CO in applicable cases, etc. The temperature of the reducing step must be high enough so that all the oxide components will reduce in the reducing atmosphere but low enough so that the metal alloy does not melt. Since reduction may be an exothermic reaction, the temperature of the compact may be higher than the ambient temperature in the heating apparatus during reduction. As used herein, "reduction temperature" means the temperature of the compact itself during reduction, whereas the temperature given in the Examples below is the ambient temperature in the heating apparatus.

One embodiment of the present invention is the case of alloys that would otherwise segregate upon cooling to room temperature after reduction. Such alloys thus have an immiscibility region below the reduction temperature. For this case, a quenching step is added that maintains the alloy in the single phase. One advantage of the present method is that the individual metal components cannot segregate during the heating of the oxides, preventing the possibility of segregation until reduction occurs. Thus, even though a miscibility gap exists in some temperature range below the reduction temperature for the metal species involved, the separation between metal species in the oxide agglomerates will remain in the sub-micron range, allowing rapid formation of a single phase alloy once reduction occurs. The quenching step immediately after reduction prevents segregation from occurring cooling also. Quenching as used herein means decreasing the temperature of the reduced compact at a rate sufficient to prevent segregation of the metal components. Generally for the examples cited herein, a decrease from the reduction temperature to room temperature in 5 minutes or less is sufficiently fast.

The present invention can advantageously be practical, for example, for the production of alloys containing copper, nickel and cobalt, or copper, nickel and iron, as further illustrated by the following examples of commercially available alloys, which have an immiscibility region below the reduction temperature. It is believed by the present inventors that these alloys are normally prepared commercially by cooling from a melt. If prepared by conventional powder metallurgy techniques, they would require annealing for times that are lengthy compared to the heating time required following reduction in the present method in order to obtain a single phase allow. Thus, they illustrate the advantages of the present method over conventional powder metallurgy.

EXAMPLE 1

314.1 gms Cu $(CH_3COO)_2H_2O$, 178.0 gms Ni $(CH_3COO)_24H_2O$, and 245.1 gms Co $(CH_3COO)_24H_2O$) were dissolved in a sufficient amount of $NH_4OH$ and water to yield 4 liters of solution with pH~10. The solution was spray dried and the resultant mixed acetates decomposed to a mixed oxide powder by heating in air at 750 degrees C. for 10 hours. The oxide powder was then mixed with 10 percent by weight (10/1 oxide/binder) of halowax binder dissolved in $CCl_4$ evaporated to give oxide plus binder (halowax). This mixture was put through a 20 mesh screen and finally placed in a vacuum oven at room temperature to extract any remaining $CCl_4$. The dried oxide binder mixture was pressed at approximately 25,000 lbs/in$^2$ into rod and disc shapes. The pressed pieces were heated in air at 600 degrees C. to burn off the binder and then sintered at approximately 1,000 degrees C. for 4 hours. The resulting mixed oxide parts were heated in flowing $H_2$ at 1,000 degrees C. for 1 hour and at 1,150 degrees C. for 2 hours followed by quenching to yield Cu-Ni-Co (50/21/29 weight percent) allow parts with density=8.63 gms/cc or 98 percent of maximum alloy density.

EXAMPLE 2

87.0 gms $CuCO_3$, 59.0 gms $NiCO_3$, and 61.1 gms $CoCO_3$ were dissolved in a hot solution of 400 gms ammonium citrate $[(NH_4)_2HC_6H_5O_7]$ in a sufficient amount of $NH_4OH$ and water to give 2.5 liters of pH ~ 10 solution. The $CuCO_3$, $NiCO_3$ and $CoCO_3$ were preanalyzed for true metal content. The solution was spray dried. The mixed citrate salt was decomposed, mixed with binder, pressed, heated for binder burn off, sintered in air, reacted in $H_2$, and quenched as described in Example 1 to yield Cu-Ni-Co (50/21/29 weight percent) alloy parts with density = 8.7 gm/cc or density of 99 percent of total alloy density.

EXAMPLE 3

$CuCO_3$, $NiCO_3$, $CoCO_3$ as in Example 2 were milled as solids in acetone for 8 hours. The slurry was filtered, dried and the mixed carbonates were heated in air at 850 degrees C. for 4 hours. The resultant powder was mixed with binder, pressed, heated for binder burn off, sintered in air, reacted in $H_2$, and quenches as in Example 1 to yield Cu-Ni-Co (50/21/29 weight percent) alloy parts with density = 8.6 gm/cc.

EXAMPLE 4

106.1 gms $CuSO_4$ $5H_2O$, 183.6 gms $NiSO_4$ $6H_2O$, and 159.20 gms $FeSO_4$ $7H_2O$ were dissolved in $H_2O$, spray dried, decomposed, bound, pressed, heated for binder burn off, and sintered in air as described in Example 1. The mixed oxide parts were heated in $H_2$ at 1,000 degrees C. for 3 hours followed by quenching to yield a Cu-Ni-Fe (27/41/32 weight percent) alloy with >90 percent of total alloy density.

In addition, Examples 1 through 4 were also prepared without the sintering step, with the process otherwise being the same as given. In each case, the oxides properly reduced to a single phase alloy.

To insure that the alloys produced in the above examples were in a single phase, X-ray diffraction measurements were taken on all the above examples. Further, optical microscopy was used to check the phase of Examples 1 and 4, as these form alloys that normally segregate if produced by standard powder metallurgy techniques without annealing. The result of all these measurements is that the alloys produced are all in a single phase down to at least the resolution limits of the measuring apparatus used, which is about 5 percent. Thus, if any multiple phases are present, they constitute less than 5 percent of each alloy material.

It is to be understood that the above-described examples are merely illustrative of the many possible specific embodiments which can be devised to represent application of the principles of the invention. Numerous ad varied other examples can be devised in accordance with these principles, by those skilled in the art without departing from the spirit and scope of the invention.

We claim:

1. A method of producing an article by steps comprising:

(a) pressing a metal oxide mixture into a compact, and directly thereafter (b) reducing said compact at an elevated temperature by means of a reducing atmosphere, and (c) quenching said compact, thereby yielding an alloy compact having a density greater than 90 percent of maximum alloy density, and comprising less than 5 percent of multiple phases, THE INVENTION CHARACTERIZED by forming said metal oxide mixture by steps comprising agglomerating a mixture of metal salts from a liquid solution, and decomposing said salts to form an agglomerated metal oxide mixture, each oxide species subsisting as regions having dimensions less than 1 micron in the metal oxide agglomerates so formed, with the oxides being of such composition so as to be reducible to a single phase alloy at the reduction temperature, and with said alloy having an immiscibility region below the reduction temperature.

2. A method of producing an article by steps comprising:

(a) pressing a metal oxide mixture into a compact, and (b) reducing said compact at an elevated temperature by means of a reducing atmosphere, and (c) quenching said compact, thereby yielding an alloy compact having a density greater than 90 percent of maximum alloy density, and comprising less than 5 percent of multiple phases, THE INVENTION CHARACTERIZED by forming said metal oxide mixture by steps comprising agglomerating a mixture of metal salts from a liquid solution, and decomposing said salts to form an agglomerated metal oxide mixture, each oxide species subsisting as regions having dimensions less than 1 micron in the metal oxide agglomerates so formed, with the oxides being of such composition so as to form a nonstoichiometric and substantially mutually insoluble metal oxide mixture that is reducible to a single phase alloy at the reduction temperature, and with said alloy having an immiscibility region below the reduction temperature.

3. The method of claim 2 FURTHER CHARACTERIZED by sintering said compcat in air prior to reduction.

4. The method of claims 1, 2 or 3 FURTHER CHARACTERIZED by forming said metal oxide agglomerates by spray drying a liquid solution of soluble metal salts which can be decomposed to metal oxides, and subsequently so decomposing the spray dried salts.

5. The method of claims 1, 2 or 3 FURTHER CHARACTERIZED by forming said metal oxide agglomerates by freeze drying a liquid solution of soluble metal salts which can be decomposed to metal oxides, and subsequently so decomposing the freeze dried salts.

6. The method of claims 1, 2 or 3 FURTHER CHARACTERIZED by forming said metal oxide agglomerates by co-precipitating from a liquid solution mixed salts which can be decomposed to metal oxides, and subsequently so decomposing the co-precipitated salts.

7. The invention of claims 1, 2 or 3 FURTHER CHARACTERIZED in that said reducing atmosphere is a hydrogen reducing atmosphere.

8. An article produced by the method of claim 1.

9. The method of claims 1, 2 or 3 FURTHER CHARACTERIZED by composing said metal oxide mixture so as to reduce to an alloy containing copper, nickel, and cobalt.

10. The method of claims 1, 2 or 3 FURTHER CHARACTERIZED by composing said metal oxide mixture so as to reduce to an alloy containing copper, nickel, and iron.

11. The method of claims 1, 2 or 3 FURTHER CHARACTERIZED by composing said metal oxide mixture so as to reduce to an alloy substantially containing 50 weight percent copper, 21 weight percent nickel, and 29 weight percent cobalt.

12. The method of claims 1, 2 or 3 FURTHER CHARACTERIZED by composing said metal oxide mixture so as to reduce to an alloy substantially containing 27 weight percent copper, 41 weight percent nickel, and 32 weight percent iron.

* * * * *

UNITED STATES PATENT AND TRADEMARK OFFICE

CERTIFICATE OF CORRECTION

PATENT NO. : 4,236,924

DATED : December 2, 1980

INVENTOR(S) : Murray Robbins and Annemarie Staudinger

It is certified that error appears in the above—identified patent and that said Letters Patent is hereby corrected as shown below:

Column 4, line 19, after "occurring" insert --during--; lines 26 and 27, "practical" should read --practiced--; line 55, after "$CCl_4$" insert --to make a slurry. The slurry was mixed while the $CCl_4$--; line 67, "allow" should read --alloy--. Column 5, line 21 "quenches" should read --quenched--; line 53, "ad" should read --and--. In the claims, column 6, line 37, "compcat" should read --compact--.

Signed and Sealed this

*Sixteenth* Day of *March 1982*

[SEAL]

*Attest:*

GERALD J. MOSSINGHOFF

*Attesting Officer*

*Commissioner of Patents and Trademarks*